US009984594B2

(12) United States Patent
Brown et al.

(10) Patent No.: US 9,984,594 B2
(45) Date of Patent: May 29, 2018

(54) WIRE LABEL WITH CARRIER

(71) Applicant: HellermannTyton Corporation, Milwaukee, WI (US)

(72) Inventors: James T. Brown, Wind Lake, WI (US); Brock S. Klaus, Grafton, WI (US); James A. Petersen, Hartford, WI (US)

(73) Assignee: HELLERMANNTYTON CORPORATION, Milwaukee, WI (US)

( * ) Notice: Subject to any disclaimer, the term of this patent is extended or adjusted under 35 U.S.C. 154(b) by 195 days.

(21) Appl. No.: 14/701,797

(22) Filed: May 1, 2015

(65) Prior Publication Data

US 2015/0314904 A1 Nov. 5, 2015

Related U.S. Application Data

(60) Provisional application No. 61/987,258, filed on May 1, 2014.

(51) Int. Cl.
*B65C 9/00* (2006.01)
*G09F 3/00* (2006.01)

(52) U.S. Cl.
CPC ..... *G09F 3/0295* (2013.01); *B65C 9/0006* (2013.01); *B65C 2009/009* (2013.01); *Y10T 156/1052* (2015.01); *Y10T 156/14* (2015.01)

(58) Field of Classification Search
CPC ..... B65C 9/0006; B65C 2009/009; G09F 3/0295; Y10T 156/1052; Y10T 156/14
See application file for complete search history.

(56) References Cited

U.S. PATENT DOCUMENTS

| | | | |
|---|---|---|---|
| 2,013,844 | A | 9/1935 | Sherman |
| 2,058,035 | A | 10/1936 | Rand |
| 2,201,950 | A | 5/1940 | Wolters et al. |
| 2,217,506 | A | 10/1940 | Bottle |
| 3,192,093 | A | 6/1965 | Tobey |
| 3,339,828 | A | 9/1967 | Hiersteiner |
| 3,894,731 | A | 7/1975 | Evans |
| 3,985,852 | A | 10/1976 | Evans |
| 4,032,010 | A | 6/1977 | Evans |
| 4,070,223 | A | 1/1978 | Stalzer |

(Continued)

FOREIGN PATENT DOCUMENTS

WO WO 97/14126 A1 4/1997

OTHER PUBLICATIONS

Web page; HellermannTyton, Heat Shrinkable Labels, dated Sep. 11, 2012, 3 pages.

*Primary Examiner* — Mark A Osele
*Assistant Examiner* — Christopher C Caillouet
(74) *Attorney, Agent, or Firm* — Robert J. Myers

(57) ABSTRACT

A label assembly comprised of a carrier strip and a plurality of labels. The carrier strip comprises at least a first backing layer and a layer of adhesive material located over said first backing layer. A second backing layer may be located over said adhesive layer. Predetermined areas are removed from the second backing area to expose the adhesive layer. Cover tabs overlay portions of the exposed adhesive layer with the labels being removably adhered to the carrier strip on the remaining exposed adhesive layer. The labels may be provided with frangible regions for partitioning the wire label. The frangible regions include both severed portions and points of attachment.

14 Claims, 4 Drawing Sheets

(56) References Cited

U.S. PATENT DOCUMENTS

| | | | |
|---|---|---|---|
| 4,191,405 | A | 3/1980 | Johnstun |
| 4,198,451 | A | 4/1980 | Johnstun |
| 4,206,909 | A | 6/1980 | Wittle |
| 4,347,274 | A | 8/1982 | Janssen |
| 4,349,404 | A | 9/1982 | Changani et al. |
| 4,361,230 | A | 11/1982 | Downing et al. |
| 4,363,401 | A | 12/1982 | Savagian |
| 4,425,390 | A | 1/1984 | Changani et al. |
| 4,442,939 | A | 4/1984 | Downing |
| 4,448,558 | A | 5/1984 | Weingarten |
| 4,461,793 | A | 7/1984 | Blok et al. |
| 4,487,645 | A | 12/1984 | Weston |
| 4,488,642 | A | 12/1984 | Changani et al. |
| 4,517,044 | A | 5/1985 | Arnold |
| 4,574,440 | A | 3/1986 | Wirth et al. |
| 4,586,610 | A | 5/1986 | Gandolfo |
| 4,655,129 | A | 4/1987 | Wirth et al. |
| 4,686,144 | A | 8/1987 | Hupfer et al. |
| 4,865,895 | A | 9/1989 | Vlamings et al. |
| 5,110,638 | A | 5/1992 | Vogdes et al. |
| 5,262,214 | A | 11/1993 | Instance |
| 5,788,796 | A | 8/1998 | Look et al. |
| 5,863,383 | A | 1/1999 | Bussey |
| 5,863,628 | A | 1/1999 | Barry |
| 6,103,051 | A | 8/2000 | Bussey |
| 6,120,637 | A | 9/2000 | Barry |
| 6,277,456 | B1 | 8/2001 | Bulgna et al. |
| 6,962,014 | B2 | 11/2005 | McCabe et al. |
| 7,691,462 | B2 | 4/2010 | Erwin et al. |
| 8,592,019 | B2 | 11/2013 | Whittaker et al. |
| 2003/0204006 | A1 | 10/2003 | Moriuchi et al. |
| 2005/0153113 | A1 | 7/2005 | Hseih et al. |
| 2006/0040083 | A1 | 2/2006 | Erwin et al. |

WIRE LABEL WITH CARRIER

RELATED APPLICATION

This application claims the benefit of U.S. Provisional Patent Application Ser. No. 61/987,258, filed 1 May 2014.

BACKGROUND OF THE INVENTION

The present invention relates to labeling devices, and, more specifically, to labeling devices that are used in connection with electronic printing devices.

In certain devices or equipment, such as airplanes, boats, computer networks or equipment that contains many wires, cables, or other items that may either get easily tangled or confused with other similar items, it is necessary to label the wires, cables or groups of cables of wires. Tags and marker assemblies have been designed to form labels for such uses. Heat shrink technology has been employed in making these markers and tags thereby permitting easy installation. Once applied, the labels are difficult to remove.

Generally, a carrier strip of material containing a plurality of markers is fed through a machine, whereby the markers will pass through a printing station for imprinting images onto each marker. Previous designs for carrying out the process utilize carrier strips that are bulky and not adapted for use in different types of printers. Such carriers tend to be stiff, which may cause the images printed on the markers to be distorted. Further, the stiff material may not be easily moved through the printer, since the carrier may have to negotiate curves or bends within the assembly.

Likewise, stiffer material is generally more expensive to produce and may need to be wider than necessary so that there is a sufficient area to move and rotate the carrier. For instance, many current carrier strip designs are track driven or use pin feeds for the carriers' movement. This may require a wider strip, which also adds to the cost of the material needed for producing the carrier strips.

U.S. Pat. No. 6,277,456 to Bulgrin, et. al., discloses a label assembly where the labels carried by the carrier strip are integral with the carrier strip. A die cutting process that also cuts away portions of the carrier strip defines the labels. Tack points remain in the die cutting process to keep the labels connected to the carrier strip. The carrier strip is relatively thick and stiff and may not be easily fed through certain printers.

U.S. Pat. No. 4,865,895 to Vlamings et al., discloses a marker sleeve assembly wherein the labels are attached and adhered to a stiff, relatively thick carrier strip by placing the labels between the edges of two layers material. The labels are attached to the inner edge of the carrier strip and care must be taken to properly align the labels with the carrier strip. For instance, the labels must be positioned properly so that they are not too close or too far away from the carrier strip so that the labels will properly fit within a printing assembly and, also, that they are not positioned too close together for proper printing. This is especially true for a pin feed-type drive, where registration is based on the pin feed.

U.S. Pat. No. 7,691,462 to Erwin et al. discloses a wire label with carrier wherein the labels are attached and adhered to a carrier strip by an adhesive layer applied to the backing layer and an overlaying adhesive tape. The ends of the labels are positioned between the adhesive layer and the adhesive tape. While this arrangement does provide support for the labels during printing, the arrangement may induce excess adherence of the label ends to the backing layer and thereby hampers facile removal of the printed labels from the backing layer.

A new carrier strip for a printing assembly is desired that will provide the needed support for the labels, while providing a high degree of flexibility for the carrier strip for use in printing machines. The carrier strip should also allow the labels to be adjoined to the carrier strip in an efficient and relatively straightforward registration process, while further allowing easy removal therefrom for use.

SUMMARY OF THE INVENTION

The present invention discloses a carrier strip for wire labels used in printing machines and assemblies and a method for manufacturing the carrier strip. The carrier consists of a first and second backing layer adhered to one another, sandwiching an adhesive layer between the two backing layers. Predetermined areas are removed from the second backing layer to thereby expose the adhesive. Portions of the exposed adhesive are further covered by a plurality of cover tabs, which create a series of exposed windows of adhesive. The windows of adhesive are located on opposing sides of the carrier, corresponding to the ends of wire labels placed on the carrier strip. Once the wire labels are placed over the carrier strip, a layer of adhesive tape is placed over the ends of the wire labels, preferably covering any remaining exposed adhesive located in the windows of adhesive and further securing the wire label ends to the carrier strip. The use of cover tabs to create windows of adhesive allows the labels to be secured to the carrier strip with minimal contact with the adhesive. This feature improves removal of the wire labels after printing.

The present invention also has the advantage of specialized perforations on individual wire labels when individual wire labels are to be multiply printed and divided into multiple, smaller labels. The perforations define a frangible region that comprises both cut portions and points of attachment, where the cut portions sever the wire label completely and the remaining points of attachment serve as the sole connection to an adjacent wire label. The frangible region allows the labels to be secured to one another during printing, yet be easily separated during use.

The carrier strip layers are preferably made of a polyethylene material, with each of the layers preferably having a thickness of less than 3 mils. The overall thickness of the carrier strip is preferably less than 7 mils, which is a significant improvement over thicknesses of previous carrier strips. The present carrier strip allows for easier feeding and movement within a printing station or assembly, especially when the carrier strip must move over a curved area or corner in the printing assembly. The carrier strip also allows for easier printing on the labels, since the flexibility of the carrier strip will minimize bowing of the labels and the strip. The carrier strip, including the exposed adhesive, combined with the labels, creates a unitary structure that is rigid and supportive for the printing process.

These and other advantages will be further described in the detailed description and the drawings.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
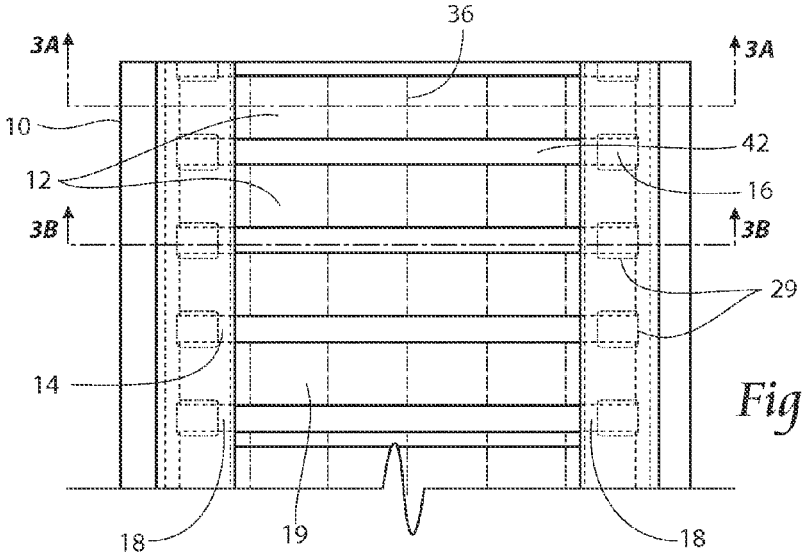
FIG. 1 depicts a fragmentary top plan view of a carrier strip and labels in accordance with the present invention.

FIG. 1 shows a top plan view of a carrier strip 10 and a plurality of wire labels 12 to be printed adhered on top of the carrier strip 10. Like parts will be referred to with like reference numerals. The wire labels 12 have a first end 14 and a second end 16 and are arranged substantially laterally to the carrier strip 10. The spacing and size of the wire labels 12 may be of any desired size or orientation. The wire labels 12 are preferably longitudinally spaced from one another at equal intervals. A pair of adhesive tapes 18 is placed respectively over the first end 14 and the second end 16 of the labels 12. An intermediate portion 19 of the labels 12 is not adhered to the carrier strip 10 and the labels 12 are free to flex as necessary within a printing device.

Figure 2A:
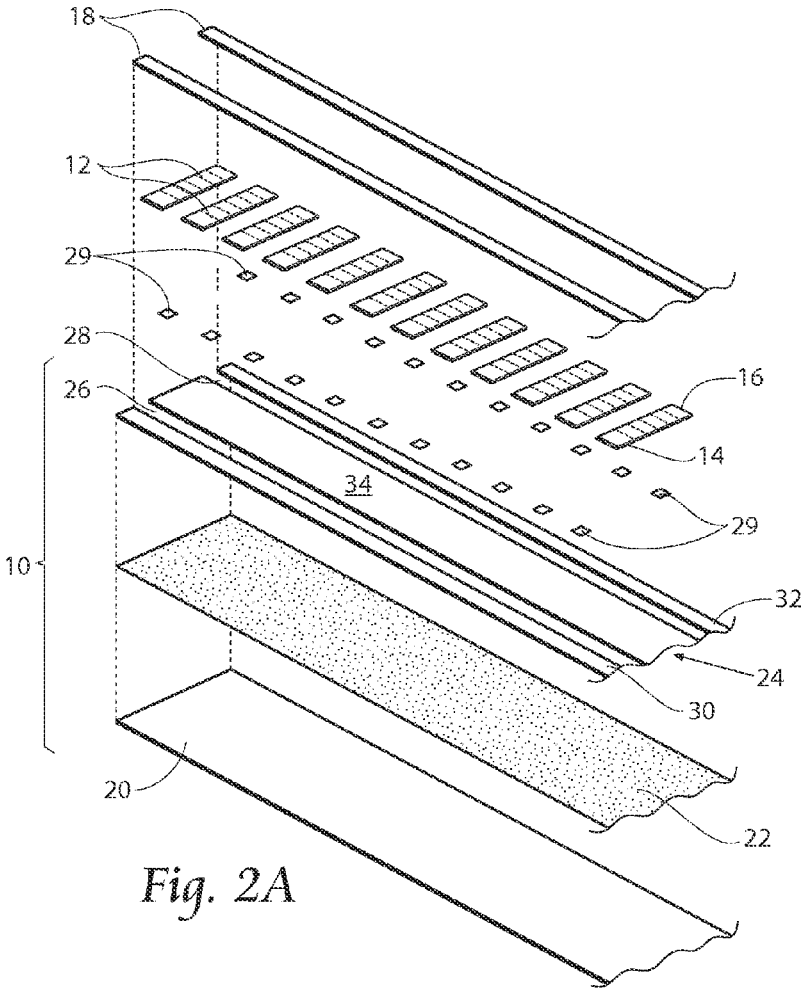
FIG. 2A is a fragmentary exploded perspective view of the carrier strip and labels illustrated in FIG. 1.

FIG. 2A is an exploded perspective view of a partial section of the carrier strip 10. The carrier strip 10 generally is comprised of three sections: a first backing layer 20, an adhesive layer 22, and a second backing layer 24. The adhesive layer 22 will preferably cover the entire first backing layer 20. The first backing layer 20 and the second backing layer 24 preferably are of substantially the same overall width and length. A first predetermined area 26 and a second predetermined area 28 may be removed from the second backing layer 24, with the areas 26, 28 preferably formed by a die cutting process. When the areas 26, 28 are removed, the adhesive layer 22 is exposed within the areas 26 and 28. Furthermore, a plurality of cover tabs 29 is positioned within the areas 26, 28 and over predetermined portions of the exposed adhesive layer 22 to create a series of exposed windows 25 of adhesive (see also FIG. 2B). The windows 25 of adhesive are located on the carrier 10 at positions corresponding to the ends 14, 16 of the wire labels 12 placed on the carrier strip 10, which provides for the wire labels 12 to be adhered to the carrier strip 10. The predetermined areas 26 and 28 are preferably transverse of the width of the carrier strip 10, underlying the ends 14 and 16 of the label 12.

Figure 2B:
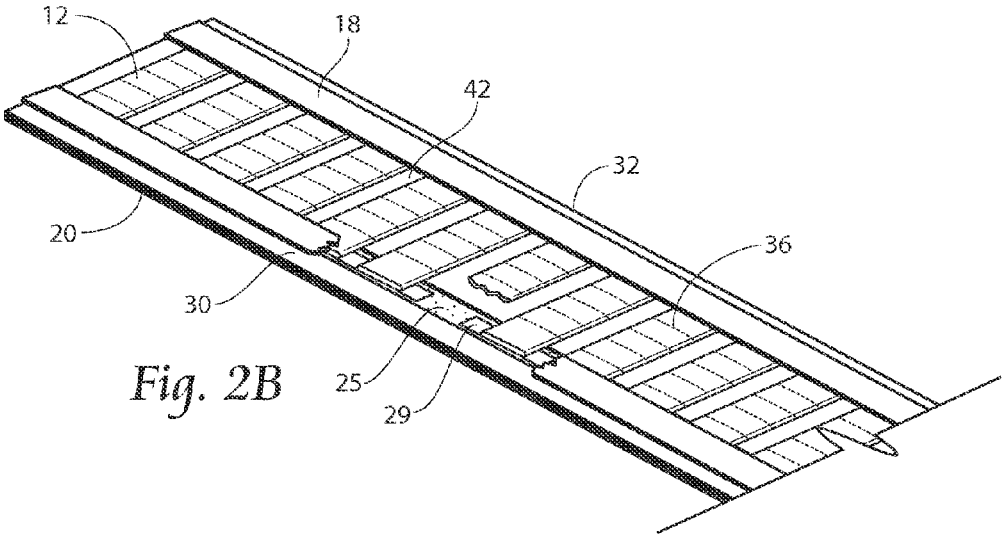
FIG. 2B is a fragmentary perspective view of the carrier strip and labels illustrated in FIGS. 1 and 2A.

Still referring to FIGS. 2A and 2B, the predetermined areas 26 and 28 may be seen to divide the second backing layer 24 into a first edge section 30, a second edge section 32 and a central section 34. The predetermined areas 26 and 28, along with the cover tabs 29 provide an adhesive window 25 for the label 12 ends 14 and 16 to be removably secured to the adhesive layer 22 and to thereby secure the wire labels 12 to the carrier strip 10. The wire labels 12 are placed over the second backing layer 24 and cover tabs 29, with the strips of adhesive tape 18 being placed over the ends 14 and 16. The strips of adhesive tape 18 assist in further securing the labels 12 to the carrier strip 10 as the tapes 18 cover the predetermined areas 26, 28 and cover tabs 29. The carrier strip 10 will be preferably be as wide as the entrance slot of a printing station (not shown), with the first and second edge sections 32 and 34 interacting with the feeding means of the printing assembly. The carrier strip 10 does not require feedholes or apertures as needed in the prior art for interacting with a sprocket drive of a printing machine. Thus, less material is needed for the carrier strip 10, which results in a more cost-efficient process compared to the prior art. Also, the labels 12 may encompass a wider section of the width of the carrier strip 10 than previous designs, which allows for a larger printing area for the labels 12 relative to the size of the carrier strip 10. Overall, the width of the labels 12 may be varied by adjusting components of the carrier strip 10 to repeat the label design using the adjusted width.

Figure 3A:
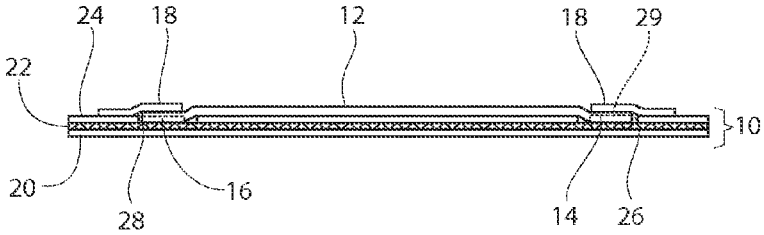
FIG. 3A is a cross-sectional view of the carrier strip and labels and taken along line 3A-3A of FIG. 1.
Figure 3B:
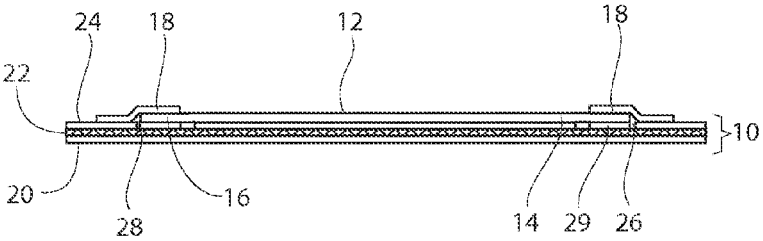
FIG. 3B is a cross-sectional view of the carrier strip and labels and taken along line 3B-3B of FIG. 1.

FIGS. 3A and 3B show enlarged cross-sectional views of the carrier strip 10 taken along lines 3A-3A and 3B-3B respectively, of FIG. 1. As previously discussed, the carrier strip 10 comprises a first backing layer 20, a second backing layer 24, a plurality of cover tabs 29, and an adhesive layer 22. A wire label 12 is placed over the carrier strip 10, with the first end 14 and the second end 16 located over the adhesive windows 25 formed in the first predetermined area 26 and the second predetermined area 28, respectively. As mentioned earlier, the adhesive windows 25 are formed by the cover tabs 29. The labels 12 and the adhesive layer 22 and adhesive windows 25 may be arranged so that the label ends 14, 16 are sufficiently adhered to the carrier strip 10; however, placement of the adhesive tapes 18 over the label ends 14 and 16 further secures the labels 12 to the carrier strip 10 and preferably covers any exposed adhesive layer 22 within the adhesive windows 25. The tapes 18 have sufficient adhesive qualities so that they will remain on the carrier strip 10 during printing and until it is desired to remove the labels 12. Further, the tapes 18 are preferably designed to be removed and refastened to the carrier strip 10 and the labels 12, if necessary. It is to be noted that, due to the enlarged view, the ends 14, 16 of the labels 12 are shown as being bent more than normally will occur. FIGS. 3A and 3B are used as an example of the layers of the carrier strip 10, and not necessarily how the wire labels 12 will spatially rest upon the carrier 10.

Figure 4:
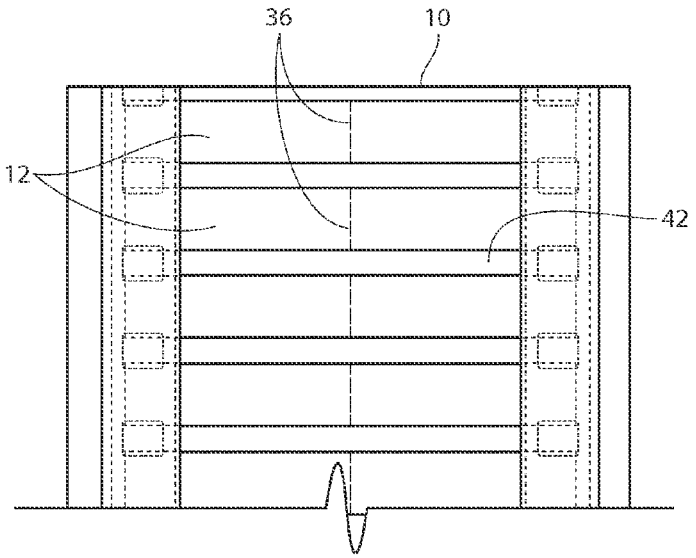
FIGS. 4 and 5 are fragmentary top plan views of carrier strips containing labels marked for specifically dimensioned labels.
Figure 5:
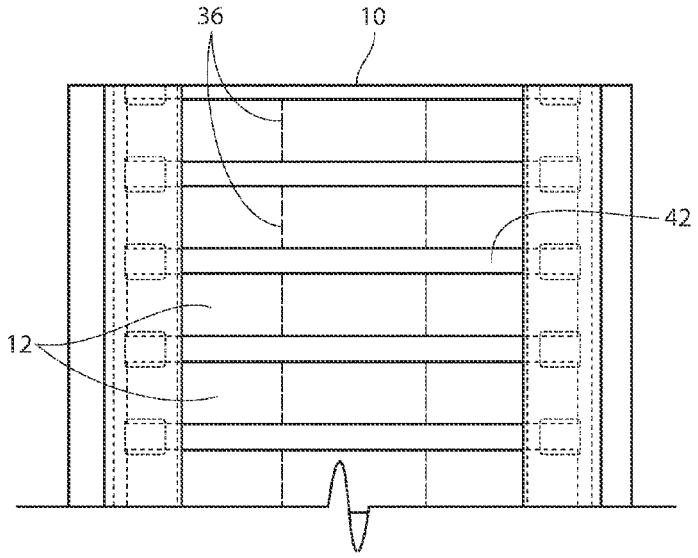

FIGS. 4 and 5 illustrate further top plan views of the carrier strip 10 and wire labels 12. As seen, the labels 12 may include a frangible region 36. The frangible region 36 allows the wire labels 12 to be partitioned, to thereby provide the ability to print more than one set of information on each of the wire labels 12, and to then divide the label 12 into multiple individual labels. For example, the frangible regions 36 in FIG. 4 provide for two sets of information (and two individual labels) on each of the labels 12, and the frangible regions 36 in FIG. 5 provide for three sets of information, and therefore three individual labels. The frangible regions 36 are preferably rows of perforations, which thereby allow the individual labels 12 to be separated after printing.

Figure 6:
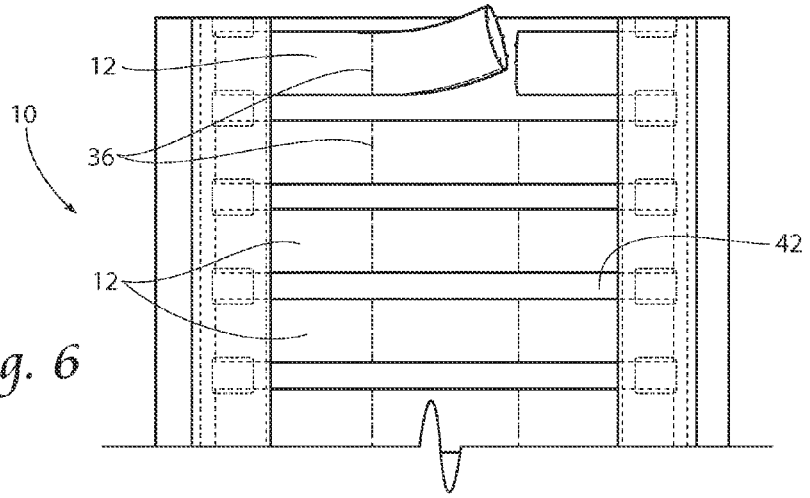
FIG. 6 is a view similar to that of FIG. 5, but showing an individual label separated from an adjacent label.
Figure 7:
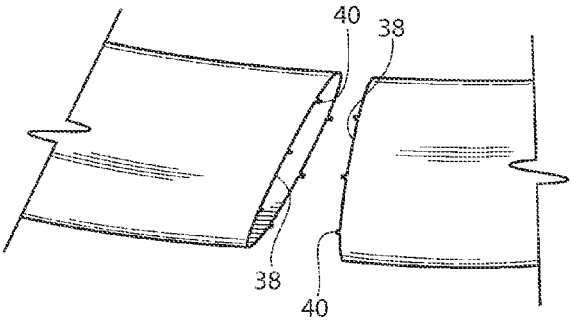
FIG. 7 is an enlarged fragmentary view of a label according to the present invention and showing perforation with points of attachment.

With particular attention now to FIGS. 6 and 7, a frangible region 36 may be more specifically viewed. As seen, the frangible region 36 is a row perforations having both cut portions 38 and points of attachment 40, where the cut portions 38 sever the wire label 12 completely and the remaining points of attachment 40 serve as the sole connection to an adjacent wire label 12. This unique arrangement differs from prior wire labels in which a top layer of the label is severed and leaving the bottom layer intact. In such arrangements, the end user must manually sever the intact layer, causing rips, uneven tearing and the like. Furthermore, the present frangible region 36 allows the wire labels 12 to be secured to one another during printing, yet permit facile division of the conjoined, printed labels 12, since the relatively small points of attachment 40 are easily separated.

Figure 8:
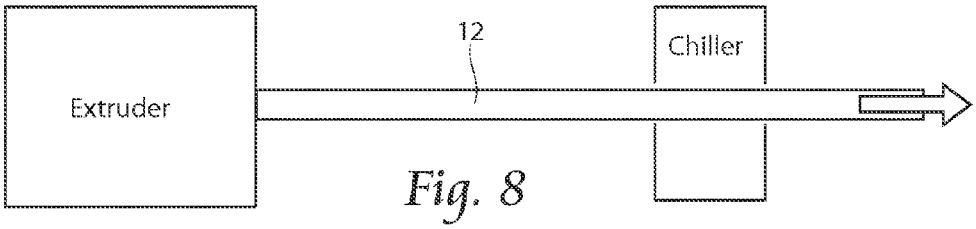
FIG. 8 is a schematic showing wire labels being extruded and passed through a chiller.
Figure 9:
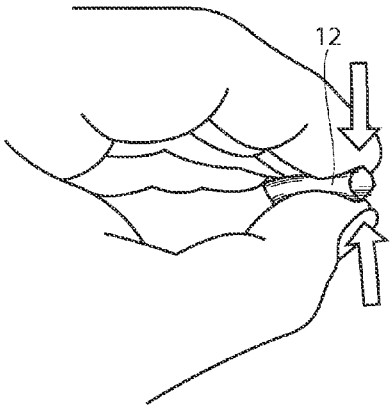
FIG. 9 is a view of a detached label and showing the label in an open position ready to receive a wire.

FIGS. 8 and 9 illustrate a method of manufacturing and use of wire labels 12 for use with the present, carrier 10. As seen particularly in FIG. 8, the labels 12 may be formed by extrusion from a conventional extruding device. After extrusion, the labels 12 are passed through a chiller (see FIG. 8). Use of the chiller causes the wire labels 12 to bias in a partially open position as is shown in FIG. 9. After chilling, the labels 12 may be spooled (not, shown) for use during assembly of the carrier strip 10. When the wire labels 12 are biased in a partially open position they are easier to manipulate and the user may more readily install a wire (not shown) therein.

The sections and areas removed from the described embodiments are preferably formed using a die cutting process. For example, referring to FIG. 2A, a die cutting machine may be used to remove the first and second areas 26, 28 from the second backing layer 24. Likewise, a die cutting process may be utilized to form the cover tabs 29. A method for making a carrier strip 10 for a wire label 12 having a first end portion 14, a second end portion 16, and an intermediate portion 19 is also contemplated. A method may include the steps of: providing a first backing layer 20; coating the first backing layer 20 with an adhesive material to form an adhesive layer 22; providing a second backing layer 24; placing the second backing layer 24 over the adhesive layer 22 and the first backing layer 20; adhering the second backing layer 24 to the first backing layer 20; cutting and removing a first predetermined area from the second backing layer 24, thereby providing an exposed portion of adhesive material; providing at least one cover tab 29; and providing a first adhesive window 25 by placing the at least one cover tab 29 over a predetermined portion of the exposed portion of the adhesive material 22. The method may also include the steps of: cutting and removing a second predetermined area from the second backing layer 24, thereby providing a second exposed portion of the adhesive material 22; providing a second cover tab 29; providing a second adhesive window 25 by placing the second cover tab 29 over a predetermined portion of the second exposed portion of the adhesive material 22; adhering the first end portion 14 of the label 12 to the first adhesive window 25; and adhering the second end portion 16 of the label 12 to the second adhesive window 25. Further method steps may include providing a pair of adhesive tapes 18; placing the adhesive tapes 18 over respective first and second ends 14, 16 of the label 12; and adhering the adhesive tapes 18 to the carrier strip 10; providing the label 12 with a frangible region 36; providing the frangible region 36 with at least one point of attachment. 40 and at least one severed portion 38.

Furthermore, the dimensions shown and described for the removed sections may be adapted and still fail within the scope of the invention. The predetermined areas where the labels are adhered to the carrier strip are shown generally as being coextensive with the length of the label assemblies (see FIG. 2). However, the predetermined areas could be formed to more closely correspond with the ends of the labels. That is, a series of individual cutout sections approximate to the size of the ends of the labels could be formed, instead of one long area along each side of the carrier strips.

The present invention provides a flexible carrier strip that provides sufficient support for the labels 12 as they are fed through a printing assembly. The two backing layers 20, 24 that make up the carrier strip 10 are preferably made from a clear material, such as a clear polyethylene material. The use of a clear material allows a printing assembly (not shown) to advance and move the labels 12 when printing, without needing timing marks located on the carrier strip 10. An optical sensor (not shown) on the printer senses the space 42 between adjacent labels 12.

The carrier strip 10, as previously noted, may be formed of layers of clear polyethylene material. The polyethylene material generally has a thickness of about between 1.5-3 mils. The layer of adhesive material preferably will have a thickness of between 0.8-1.0 mils. The overall thickness of the carrier strip 10 is less than 7 mils, and more approximately between 3.5-6 mils. The relatively thin carrier strip 10 is flexible, which makes it easier for the strip 10 to navigate through a printing assembly and still maintain sufficient contact between the wire labels 12 and a print head located within the printing assembly (not shown).

The dimensions of the carrier strip 10 are determined by the specific printing assembly and the desired wire label 12 length, and are not a limitation upon the carrier strip 10. That is, the carrier strip 10 may be adapted to be used in a wide range of printing assemblies. However, the design of the present invention provides for a more efficient use of the printing area located on the labels in comparison to the overall size of the carrier strip.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A label assembly comprising:

a carrier strip, wherein said carrier strip comprises a first backing layer, a layer of adhesive material located over said first backing layer, a second backing layer located over said adhesive layer, a first predetermined area being removed from said second backing layer to thereby provide an exposed portion of said adhesive layer, at least one cover tab overlaying a predetermined portion of said exposed portion of said adhesive layer to thereby provide a window of adhesive, and a second predetermined area, said second predetermined area being removed from said second backing layer to thereby provide a second exposed portion of said adhesive layer; and a label having a first end and a second end, said label being located on said carrier strip, said first end of said label overlying and removably adhering to said window of adhesive;

a first adhesive tape, said first adhesive tape overlying said first end of said label and said cover tab; and a second cover tab overlaying a predetermined portion of said second exposed portion of said adhesive layer to thereby provide a second window of adhesive; said second end of said label overlying and removably adhering to said second window of adhesive.

2. The label assembly according to claim 1, further comprising:

a first adhesive tape located overlying said first end of said label and said at least one cover tab; and a second adhesive tape overlying said second end of said label and said second cover tab.

3. The label assembly according to claim 2, further comprising a plurality of said labels being adhered to said carrier strip.

4. The label assembly according to claim 3 wherein at least one of said plurality of labels includes a frangible region.

5. The label assembly according to claim 3 wherein said frangible region includes at least one point of attachment and at least one severed portion.

6. The label assembly according to claim 1, wherein said first and said second backing layers are substantially the same size.

7. The label assembly according to claim 1, wherein said carrier strip has a thickness of less than 15 mils.

8. The label assembly according to claim 7, wherein said carrier strip has a thickness of less than 7 mils.

9. The label assembly according to claim 1, wherein said carrier strip comprises a transparent material, thereby allowing said label to serve as a printer advancement mark.

10. A method for making a carrier strip for a label, said label having a first end portion, a second end portion, and an intermediate portion, the method comprising the steps of:

providing a first backing layer;

coating said first backing layer with an adhesive material;

providing a second backing layer;

placing said second backing layer over said adhesive material and said first backing layer;

adhering said second backing layer to said first backing layer;

cutting and removing a first predetermined area from said second backing layer, thereby providing an exposed portion of said adhesive material;

providing at least one cover tab;

providing a first adhesive window by placing said at least one cover tab over a predetermined portion of said exposed portion of said adhesive material;

cutting and removing a second predetermined area from said second backing layer, thereby providing a second exposed portion of said adhesive material;

providing a second cover tab; and providing a second adhesive window by placing said second cover tab over a predetermined portion of said second exposed portion of said adhesive material.

11. The method according to claim 10, further comprising the steps of:

adhering said first end portion of said label to said first adhesive window; and adhering said second end portion of said label to said second adhesive window.

12. The method according to claim 11, further comprising the steps of:

providing a pair of adhesive tapes;

placing said adhesive tapes over a respective said first and said second ends of said label; and adhering said adhesive tapes to said carrier strip.

13. The method according to claim 11, further comprising the step of:

providing said label with at least one frangible region.

14. The method according to claim 13, further comprising the step of:

providing said at least one frangible region with at least one point of attachment and at least one severed portion.

* * * * *